US007994942B2

(12) United States Patent
Kim et al.

(10) Patent No.: US 7,994,942 B2
(45) Date of Patent: Aug. 9, 2011

(54) METHOD AND APPARATUS FOR DELIVERING DATA BASED ON SENSOR NETWORK

(75) Inventors: Do Hyun Kim, Daejeon (KR); Jeong Dan Choi, Daejeon (KR); Byung Tae Jang, Daejeon (KR); Jung Sook Kim, Seoul (KR); Jae Jun Yoo, Daejeon (KR); Kyung Bok Sung, Daejeon (KR); Jae Han Lim, Daejeon (KR); Kyeong Tae Kim, Chuncheon-si (KR); Jeong Ah Jang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 403 days.

(21) Appl. No.: 12/215,397

(22) Filed: Jun. 27, 2008

(65) Prior Publication Data

US 2009/0128324 A1 May 21, 2009

(30) Foreign Application Priority Data

Nov. 16, 2007 (KR) ..... 10-2007-0117199

(51) Int. Cl.
*G08G 1/123* (2006.01)

(52) U.S. Cl. ..... 340/995.19; 340/901

(58) Field of Classification Search ..... 340/995.19, 340/901, 903, 905, 539.28; 701/1, 117; 455/11.1
See application file for complete search history.

(56) References Cited

U.S. PATENT DOCUMENTS

| | | | | |
|---|---|---|---|---|
| 6,130,626 | A * | 10/2000 | Kane et al. | 340/905 |
| 6,639,520 | B2 * | 10/2003 | Nomura et al. | 340/905 |
| 6,765,495 | B1 * | 7/2004 | Dunning et al. | 340/903 |
| 6,900,740 | B2 * | 5/2005 | Bloomquist et al. | 340/905 |
| 6,985,089 | B2 * | 1/2006 | Liu et al. | 340/903 |
| 7,031,655 | B2 * | 4/2006 | Nomura et al. | 455/7 |
| 7,286,825 | B2 | 10/2007 | Shishido et al. | |
| 7,397,390 | B2 * | 7/2008 | DiPiazza | 340/905 |
| 7,817,064 | B2 * | 10/2010 | Nishida | 340/905 |
| 7,835,690 | B2 * | 11/2010 | Burg et al. | 455/11.1 |
| 2007/0030168 | A1 | 2/2007 | Kim et al. | |
| 2007/0042711 | A1 | 2/2007 | Lim et al. | |
| 2007/0133469 | A1 | 6/2007 | Shin et al. | |
| 2009/0045977 | A1 * | 2/2009 | Bai et al. | 340/905 |

FOREIGN PATENT DOCUMENTS

| | | |
|---|---|---|
| JP | 2004-78562 | 3/2004 |
| JP | 2005-45340 | 2/2005 |
| JP | 2005-333225 | 12/2005 |
| JP | 2007-41897 | 2/2007 |
| KR | 100652963 | 11/2006 |
| KR | 1020070067590 | 6/2007 |

* cited by examiner

*Primary Examiner* — Shirley Lu
(74) *Attorney, Agent, or Firm* — Staas & Halsey LLP

(57) ABSTRACT

The present invention relates to a method and apparatus for delivering data based on a sensor network. According to an embodiment of the present invention, the apparatus for delivering data is provided in a means of transportation such as a vehicle, activates a node of a corresponding sensor network when a vehicle enters a road segment, and receives data from the transmission node. Then, the apparatus for delivering data calculates an optimum path along which the received data is delivered to a target destination, determines whether to use other vehicles or to directly deliver the data to the target destination on the basis of the calculated optimum path, and delivers the data to the target destination by the determined method. In this case, the target destination to which the data is delivered may be a different node of the same sensor network, or may be a node or a center of a different sensor network.

8 Claims, 5 Drawing Sheets

METHOD AND APPARATUS FOR DELIVERING DATA BASED ON SENSOR NETWORK

CROSS-REFERENCE TO RELATED APPLICATION

This application claims priority to and the benefit of Korean Patent Application No. 10-2007-0117199 filed in the Korean Intellectual Property Office on Nov. 16, 2007, the entire contents of which are incorporated herein by reference.

BACKGROUND OF THE INVENTION (a) Field of the Invention

The present invention relates to a method and apparatus for delivering data based on a sensor network.

The present invention is supported by the IT R&D program of MIC/IITA [2006-S-024-02, Development of Telematics Application Service Technology based on USN Infrastructure].

(b) Description of the Related Art

In the related art, there has been proposed a fixed sink as a routing method of safely delivering data between nodes of a single sensor network. However, in various fields where sensor networks are actually used, a sink is generally carried by a person or a vehicle.

For this reason, in the related art, there have been provided a method that supports the mobility of the sink by setting a specific node of sensor nodes as an access point node in order to safely deliver data even though a sink is moved and a method of resetting a data path in accordance with the movement of the sink.

However, these methods have a limitation in that data is delivered only between nodes of a single sensor network. Further, there is a problem in that the sink cannot be applied when being moved to a region where the sink cannot communicate with the sensor nodes wirelessly.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a method and apparatus for efficiently delivering data between nodes of sensor networks disposed throughout a wide region, between a sensor network and a center, or between different sensor networks.

An exemplary embodiment of the present invention provides a method of delivering data of an apparatus for delivering data that is provided in a means of transportation.

The method includes receiving data from a transmission node of a first sensor network; calculating an optimum path, along which the data is delivered, on the basis of destination information included in the data; selecting one of a delivery target destination corresponding to the destination information and at least one means of transportation that is positioned in a region determined on the basis of the means of transportation as a data destination, based on a relation between the optimum path and one of a first movement path of the means of transportation and at least one second movement path received from the at least one means of transportation positioned; and delivering the data to the data destination.

Further, another embodiment of the present invention provides an apparatus for delivering data. The apparatus includes a map database that stores node disposition information of a plurality of sensor networks; and an analysis unit that calculates an optimum path on the basis of destination information included in data received from a transmission node of a first sensor network and node disposition information corresponding to a first sensor network, compares a movement path of corresponding means of transportation and at least one of movement paths of at least one means of transportation positioned in a predetermined region determined on the basis of the means of transportation in which the apparatus is positioned with the optimum path, and delivers the data to one of a delivery target destination and at least one means of transportation.

DETAILED DESCRIPTION OF THE EMBODIMENTS

Figure 1:
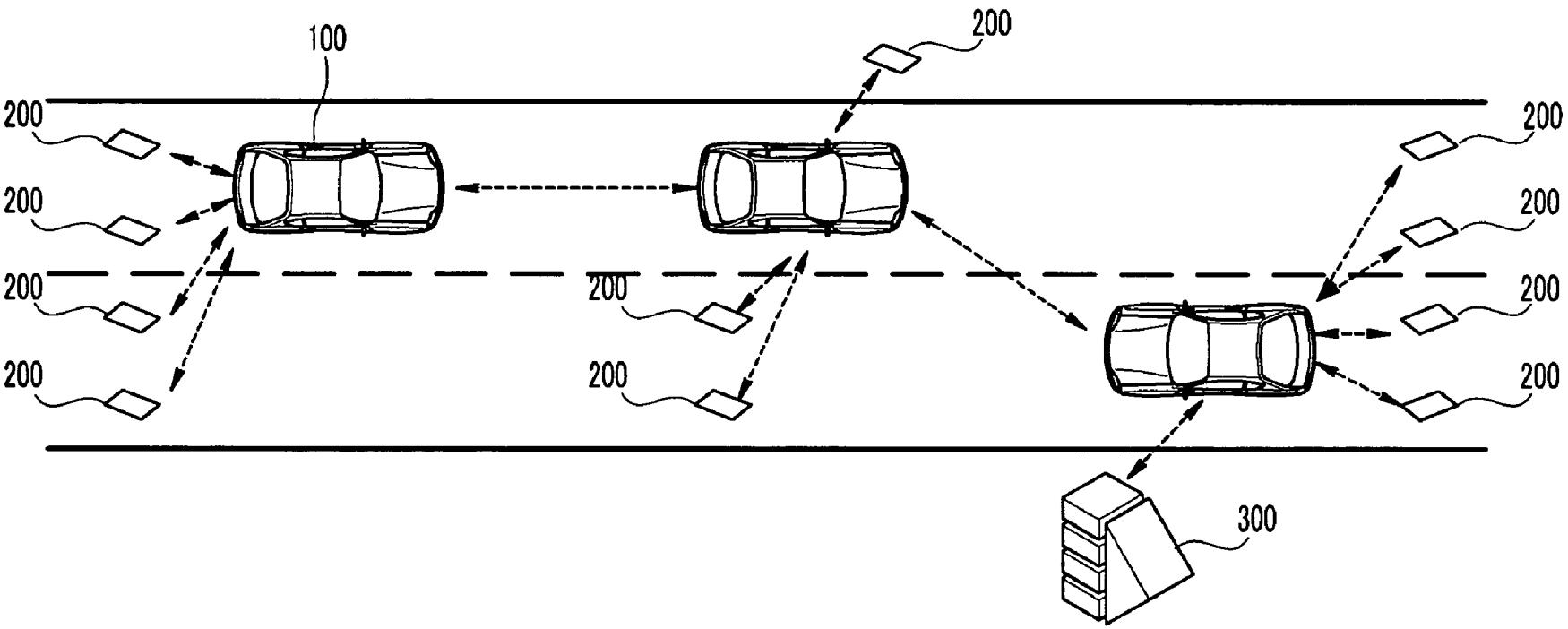
FIG. 1 is a view illustrating an example of the data delivery performed by an apparatus for delivering data, which is provided in a vehicle, according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

It will be further understood that the terms "comprise" and/or "comprising", when used in this specification, specify the presence of stated features, integers, steps, operations, elements, and/or components, but do not preclude the presence or addition of one or more other features, integers, steps, operations, elements, components, and/or groups thereof. In addition, the terms "-er", "-or", and "module" described in the specification mean units for processing at least one function and operation, and can be implemented by hardware components or software components, and combinations thereof.

A method and apparatus for delivering data based on a sensor network will be described in detail below with reference to the accompanying drawings. In particular, a method and apparatus for delivering data between nodes in a sensor network, between different sensor networks, or between a sensor network and a center will be described in detail below with reference to the accompanying drawings.

Meanwhile, a case that an apparatus for delivering data is positioned in a vehicle will be described in an exemplary embodiment of the present invention, but the present invention may also be applied to a case that an apparatus for delivering data is positioned in other means of transportation or mobile terminals.

Further, road condition information delivered through the apparatus for delivering data will be exemplified as sensing data in an exemplary embodiment of the present invention, but the present invention may also be applied to the is delivery of different kinds of sensing data.

FIG. 1 is a view illustrating an example of the data delivery performed by an apparatus for delivering data, which is provided in a vehicle 100, according to an exemplary embodiment of the present invention.

Referring to FIG. 1, a vehicle 100 includes an apparatus (not shown) for delivering data, and the apparatus for delivering data delivers data between nodes 200 in an arbitrary sensor network, between a sensor network and a center 300, or between different sensor networks.

One sensor network includes at least one node 200. The nodes 200 may be classified into a sensor node, a relay node, a sink node, and a base station according to function. The sensor node collects sensing data, that is, road condition information. The relay node receives the collected road condition information from the sensor node, and delivers the collected road condition information to a sink node. The sink node integrates, stores, and manages the road condition information that is collected by the sensor node. The base station executes an application program by using the collected road condition information. Further, in the following description, among the nodes 200 of the sensor network, a node that delivers data through the apparatus for delivering data is referred to as a transmission node, and a node that receives data through the apparatus for delivering data is referred to as a receiving node. Meanwhile, one sensor network may include neither the transmission node nor the receiving node, may include both the transmission node and the receiving node, or may include either the transmission node or the receiving node.

The center 300 performs a function to provide services, such as a traffic information service and a road condition information service, by using the road condition information received from the sensor network.

Figure 2:
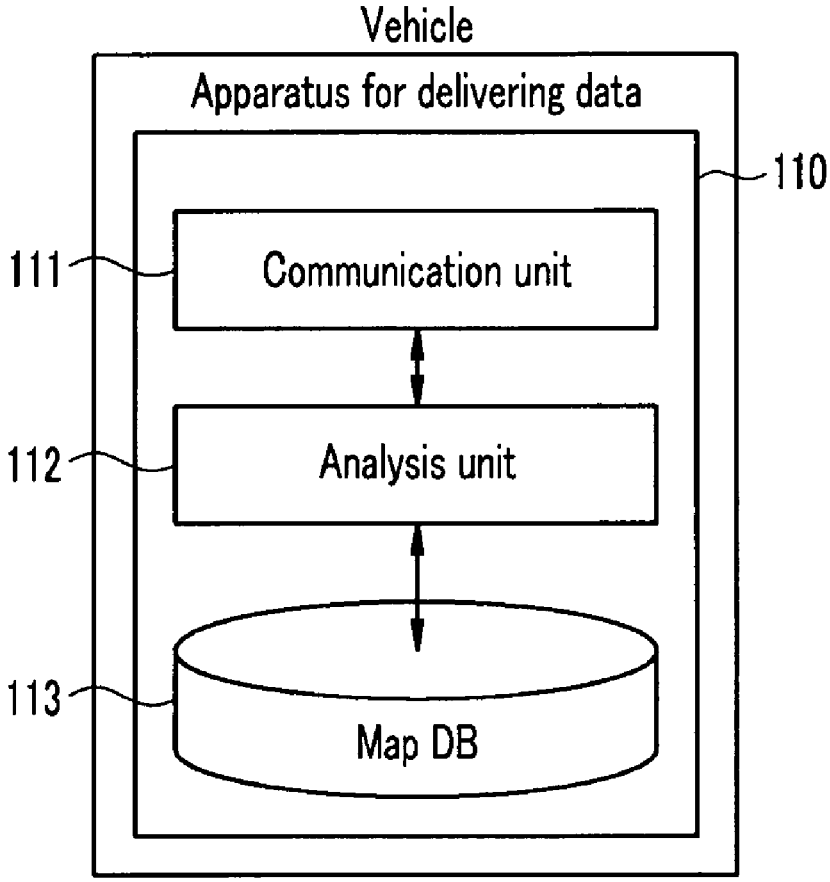
FIG. 2 is a diagram showing the configuration of the apparatus for delivering data of a vehicle according to the exemplary embodiment of the present invention.

FIG. 2 is a diagram showing the configuration of the apparatus 110 for delivering data of a vehicle 100 according to the exemplary embodiment of the present invention.

Referring to FIG. 2, the apparatus 110 for delivering data includes a communication unit 111, an analysis unit 112, and a map database (DB) 113.

The communication unit 111 includes a wireless communication module, and performs a function to transmit/receive data to/from the nodes 200 of the sensor network, other vehicles, the center 300, and the like.

The analysis unit 112 confirms a target destination of the received data by parsing the data received from the transmission node, and calculates an optimum path along which data is delivered to the destination. Further, the analysis unit compares the optimum path along which data is delivered with the movement path of the vehicle 100 on which the apparatus 110 for delivering data is mounted. The analysis unit performs a function to control the communication unit 111 so that the received data is delivered to other vehicles 100 on the basis of the degree of correspondence between the two paths and the urgency of the received data or directly delivered to the node 200 or the center 300 of the sensor network serving as a target destination.

The map DB 113 stores map data or path data that is used to presume a movement path corresponding to the target destination of the vehicle 100. Further, the map DB 113 classifies node disposition information of the sensor network that corresponds to road segments, and stores the information. Furthermore, in the case of a road segment including the center 300, the map DB 113 further stores the center disposition information corresponding to the road segment. In this case, the road segments are obtained by dividing the entire road into a plurality of segments. One road segment may include at least one sensor network. In this case, one or more node disposition information of the sensor network corresponding to the road segment may exist.

Figure 3:
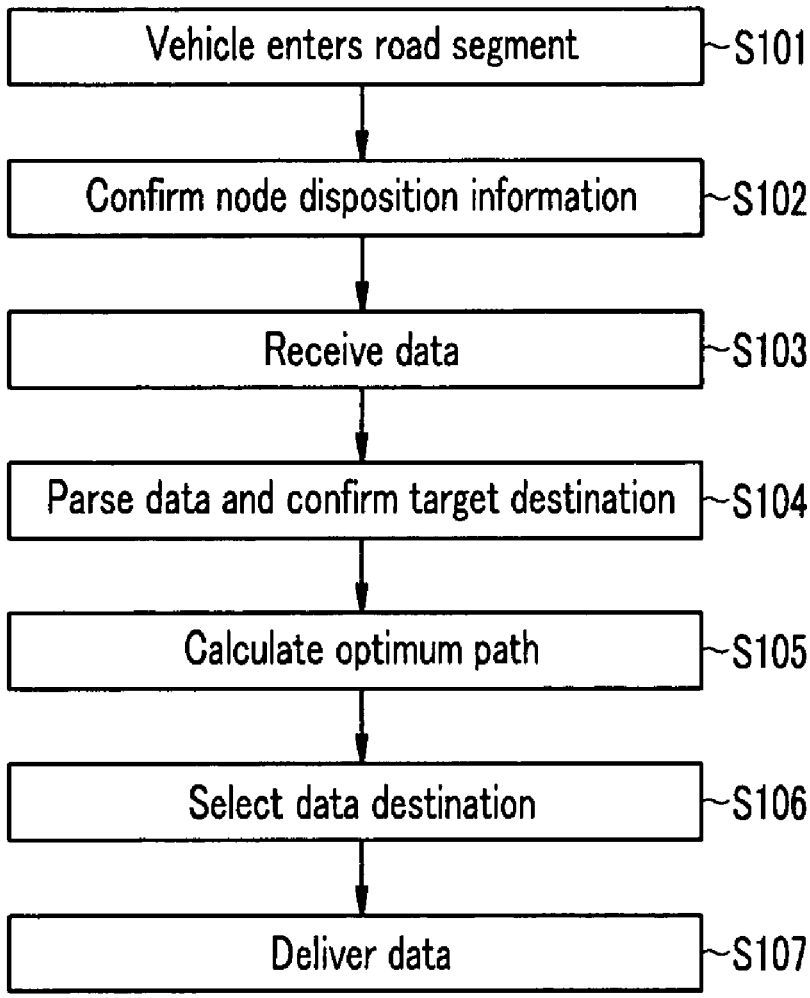
FIG. 3 is a flowchart illustrating a method of delivering data that is performed by the apparatus for delivering data according to the exemplary embodiment of the present invention.

FIG. 3 is a flowchart illustrating a method of delivering data that is performed by the apparatus 110 for delivering data according to the exemplary embodiment of the present invention.

Referring to FIG. 3, first, when the vehicle 100 enters a road segment (S101), the apparatus confirms the node disposition information of a sensor network corresponding to the road segment where the vehicle enters (S102). In this case, the apparatus 110 for delivering data can confirm the identification information of the road segment where the vehicle 100 enters by searching data stored in the map DB 113 on the basis of real-time position information of the vehicle 100, and reads the node disposition information of corresponding sensor network from the map DB 113 on the basis of the confirmed identification information of the road segment.

Meanwhile, a case that the map DB 113 previously stores the node disposition information of the sensor network corresponding to each of the road segments has been described in the exemplary embodiment of the present invention, but the present invention may also be applied to a case that the map DB 113 does not store the node disposition information of the sensor network corresponding to each of the road segments. In this case, if entering a specific road segment, the vehicle 100 may receive and use the node disposition information of a sensor network from one of the nodes 200 of the sensor network of the road segment. For this purpose, when the vehicle 100 enters the corresponding road segment, nodes for transmitting the node disposition information of the sensor network perceive the entrance of the vehicle, are activated, and transmit the node disposition information.

When a fact that the nodes of the sensor network are included in the road segment is confirmed by confirming the node disposition information of the sensor network corresponding to the road segment where the vehicle enters, the apparatus 110 for delivering data generates beacons and periodically transmits the generated beacons. Accordingly, the nodes 200 of the sensor network, which have transmitted beacons, are activated, and the apparatus 110 for delivering data receives data from the transmission nodes, which transmit data, among the activated nodes 200 (S104). Further, when the data is completely received, beacons are generated and transmitted to the nodes included in the sensor network including the transmission nodes, so that corresponding nodes are deactivated.

In this case, a basic function of each of the nodes 200 of the sensor network, for example, a function to collect road condition information or execute an application program using this, is still activated. Further, a part of the function of each of the nodes 200, for example, a wireless communication function to transmit/receive data to/from the apparatus 110 for delivering data, is activated or deactivated depending on the beacons that are transmitted by the apparatus 110 for delivering data.

Meanwhile, the transmission nodes, which transmit data by the apparatus 110 for delivering data, may vary for each sensor network. Accordingly, the data delivered by the apparatus 110 for delivering data may also vary. For example, if the transmission node is a sensor node, the data delivered by the apparatus 110 for delivering data may include road condition information that is data obtained by sensing road conditions. If the transmission node is a base station, the data delivered by the apparatus may also include road condition information, data that is obtained by quantifying the road condition information, and traffic statistics that are obtained using road condition information.

Further, the transmission node may include data to be delivered, information about a target destination to which the data is finally delivered, that is, information about the receiving node or the center 300 that serves as a target destination, and urgency information that represents the urgency of the data.

Accordingly, the apparatus 110 for delivering data confirms a target destination to which the data is delivered, by parsing the received data (S104). Further, if the target destination is a receiving node included in an arbitrary sensor network, an optimum path along which data is delivered is calculated using the node disposition information of the corresponding sensor network. If the target destination is the center 300 of the road segment where the vehicle enters, an optimum path along which data is delivered is calculated using the disposition information of the center 300 (S105). In this case, the center disposition information corresponding to the road segment where the vehicle enters may be read from the map DB 113 and then used as the disposition information of the center 300.

When the optimum path along which data is delivered is calculated as described above, the apparatus 110 for delivering data selects a data destination to which data is delivered by using the optimum path (S106). That is, the apparatus 110 for delivering data determines whether to directly deliver data to the receiving node or the center 300 that serves as a target destination or to deliver the received data to another vehicle that is optimum for the delivery of data.

When the data destination is determined, the apparatus 110 for delivering data delivers the received data to the determined data destination (S107). In this case, if the data destination is another vehicle 100, the apparatus 110 for delivering data transmits data received through the wireless communication with the vehicle 100, and the information about the optimum path along which the data is delivered. In contrast, if the data destination is the final target destination of data, data is delivered to the receiving node or the center 300 of the sensor network that serves as a target destination.

That is, if the data destination is a receiving node included in an arbitrary sensor network, the apparatus 110 for delivering data generates beacons and periodically transmits the generated beacons to the nodes of the sensor network. Subsequently, if the nodes are activated, the apparatus 110 for delivering data delivers data to the receiving node. When the data is completely delivered, the apparatus transmits the beacons, thereby deactivating the nodes of the sensor network.

Further, if the data destination is the center 300, the apparatus 110 for delivering data sets a wireless communication channel between the center 300 and itself and then delivers the received data. After delivering data, the apparatus releases the wireless communication channel.

Meanwhile, a case that the apparatus 110 for delivering data directly receives data from the transmission node of an arbitrary sensor network has been exemplified in the exemplary embodiment of the present invention, but the present invention may be applied to a case that the apparatus 110 for delivering data receives data from an apparatus 110 for delivering data of another vehicle and delivers data to a target destination or still another vehicle. In this case, when receiving data from the apparatus 110 for delivering data of another vehicle, the apparatus 110 for delivering data also receives the information about the optimum path. Therefore, the apparatus can select a data destination without performing a separate process for calculating an optimum path, and can confirm the information of the target destination to which data is delivered by analyzing the optimum path.

Figure 4:
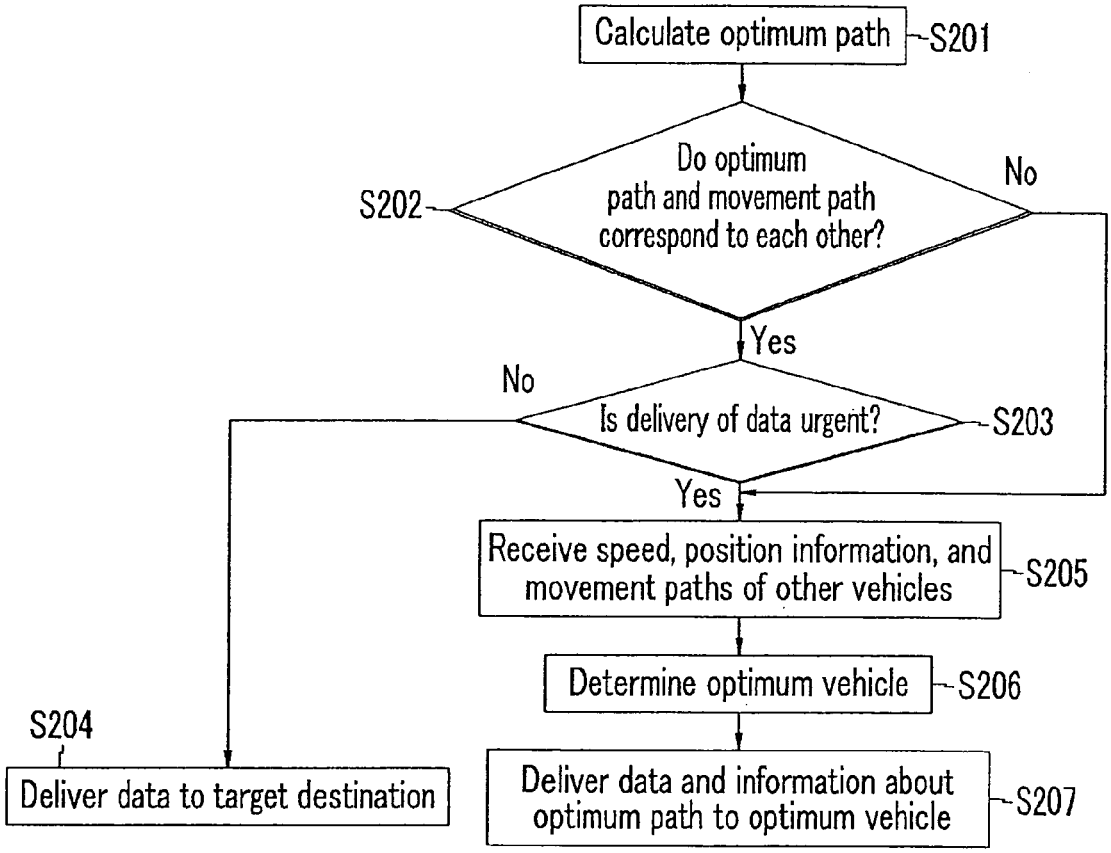
FIG. 4 is a flowchart illustrating a method of selecting a data destination that is performed by the apparatus for delivering data according to the exemplary embodiment of the present invention.

FIG. 4 is a flowchart illustrating a method of selecting a data destination that is performed by the apparatus 110 for delivering data according to the exemplary embodiment of the present invention.

Referring to FIG. 4, when the optimum path along which the received data is delivered to the target destination is calculated (S201), the apparatus 110 for delivering data compares the optimum path along which data is delivered with the movement path of the vehicle 100 (S202). In this case, the movement path of the vehicle 100 means a path that is selected as an optimum path to a target destination on the basis of path information and map data stored in the map DB 113 after a driver inputs a desired target destination to the apparatus 110 for delivering data.

Meanwhile, as the result of the comparison between the movement path of the vehicle 100 and the optimum path along which data is delivered, if the two paths correspond to each other, the apparatus 110 for delivering data confirms whether the received data includes urgency information. If the received data includes urgency information, the apparatus 110 for delivering data confirms the urgency information (S203). If the delivery of data is not urgent, the apparatus 110 determines the data destination as a target destination to which data is to be delivered, and directly delivers data to the target destination (S204).

In contrast, if the two paths do not correspond to each other or the delivery of the received data is urgent allowing that the two paths correspond to each other, the apparatus 110 for delivering data receives information about speed and movement paths of other vehicles that are positioned in a predetermined region determined on the basis of the vehicle 100 from the other vehicles (S205). Further, the apparatus determines a vehicle that is optimum for the delivery of data, on the basis of the information received from the other vehicles (S206). Then, the apparatus delivers the received data and the information about the optimum path along which the data is delivered to the determined vehicle (S207). In this case, the information about the movement path, which is received from the other vehicles, means a movement path from the current position of the corresponding vehicle to the destination of the vehicle. Accordingly, the movement path of each vehicle includes information about the current position of each vehicle.

Figure 5:
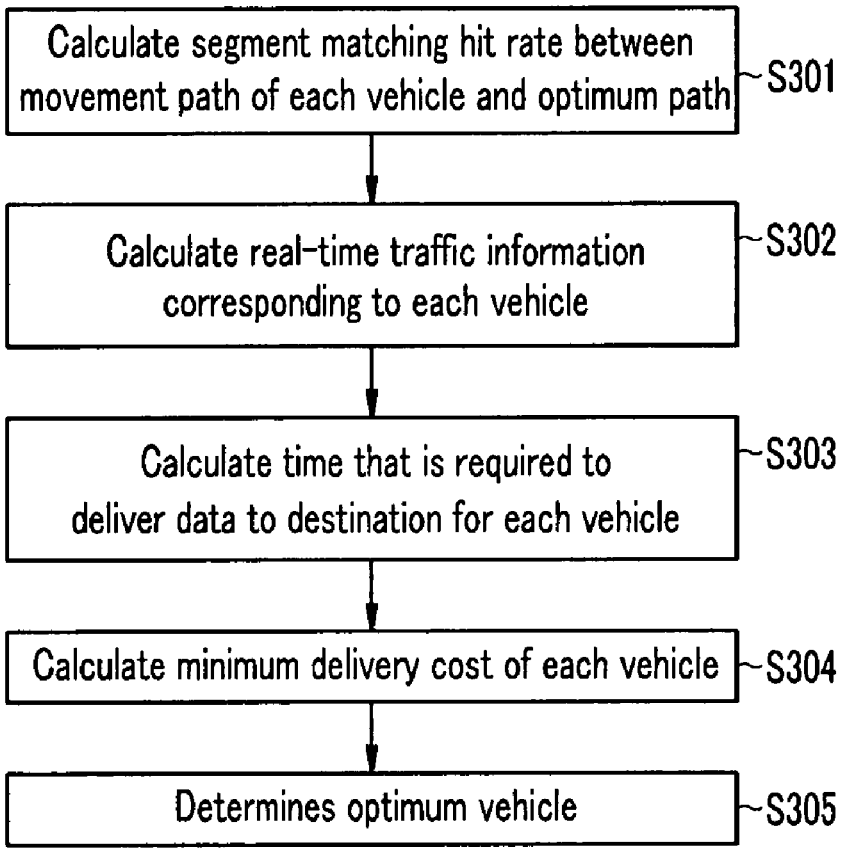
FIG. 5 is a flowchart illustrating a method of determining an optimum vehicle to which data is delivered in accordance with the exemplary embodiment of the present invention.

FIG. 5 is a flowchart illustrating a method of determining an optimum vehicle to which data is delivered in accordance with the exemplary embodiment of the present invention.

Referring to FIG. 5, the apparatus 110 for delivering data, which has received the information about the speed and movement paths from the other vehicles, calculates a segment matching hit rate between the movement path of each vehicle and the optimum path along which the data is delivered (S301).

After that, the apparatus 110 for delivering data selects a vehicle, of which the movement path includes a receiving node or a center 300 serving as a target destination, on the basis of the segment matching hit rate of each vehicle. Further, the apparatus calculates real-time traffic information that represents the traffic condition of the movement path corresponding to each selected vehicle (S302), and calculates time, which is required to deliver data to the final destination of the data for each selected vehicle, on the basis of the calculated real-time traffic information (S303). Furthermore, the apparatus calculates the minimum delivery cost of each selected vehicle in consideration of the calculated real-time traffic information and the calculated time that is required to deliver data to the target destination (S304), and determines the optimum vehicle by comparing the minimum delivery costs of the vehicles (S305).

As described above, according to the method that delivers data received from a node of an arbitrary sensor network to another node of the sensor network or a node or a center of another sensor network by an apparatus for delivering data that is provided in a means of transportation such as a vehicle, a process for re-setting a data delivery path does not need to be separately performed or separate constituent elements used for data delivery do not need to be included in a sensor network. For this reason, complexity is decreased, so that it is possible to obtain an advantage in the manufacturing costs of a sensor network. Further, it is possible to obtain the merit of efficiently delivering data between nodes of different sensor networks or between the sensor network and a center. Furthermore, nodes are activated by the apparatus for delivering data only when necessary, and therefore, it is possible to obtain an advantage in improvement of the energy efficiency of each node.

The exemplary embodiments of the present invention are not embodied only by the above-mentioned system and/or method. Alternatively, the above-mentioned exemplary embodiments may be embodied by a program performing functions, which correspond to the configuration of the exemplary embodiments of the present invention, or a recording medium on which the program is recorded. These embodiments can be easily devised from the description of the above-mentioned exemplary embodiments by those skilled in the art to which the present invention pertains.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of delivering data of an apparatus for delivering data that is provided in a first means of transportation, the method comprising:

receiving data from a transmission node of a first sensor network;

calculating an optimum path along which the data is delivered, on the basis of destination information included in the data;

selecting, as a data destination, one from among at least one second means of transportation and a delivery target destination that corresponds to the destination information, based on a relation between the optimum path and one of a first movement path of the first means of transportation and at least one second movement path received from the at least one second means of transportation, wherein the at least one second means of transportation is positioned in a region determined on the basis of the first means of transportation; and delivering the data to the data destination.

2. The method of claim 1, wherein the receiving of the data includes:

activating the transmission node by transmitting a first beacon to the transmission node; and deactivating the transmission node by transmitting a second beacon to the transmission node when the data and the destination information are received.

3. The method of claim 1, wherein the calculating of the optimum path includes:

calculating the optimum path by using disposition information of a center when the delivery target destination is the center; and calculating the optimum path by using node disposition information of a center network including a receiving node when the delivery target destination is the receiving node.

4. The method of claim 1, wherein the selecting of the data destination includes selecting the delivery target destination as the data destination when the optimum path and the first movement path correspond to each other.

5. The method of claim 4, wherein the selecting of the data destination includes:

receiving the at least one second movement path when the optimum path and the first movement path do not correspond to each other;

calculating a segment matching hit rate between the second movement path corresponding to each of the at least one second means of transportation and the optimum path;

calculating real-time traffic information of a certain means of transportation of which segment matching hit rate is a predetermined value or more;

calculating time, which is required to deliver data to the delivery target destination for the certain means of transportation;

selecting an optimum means of transportation on the basis of the real-time traffic information and the required time; and selecting the optimum means of transportation as the data destination.

6. The method of claim 5, wherein the delivering of the data includes delivering the data and the optimum path to the optimum means of transportation when the data destination is the optimum means of transportation.

7. The method of claim 1, wherein the delivery target destination is a receiving node of the second sensor network.

8. The method of claim 7, wherein the delivering of the data includes:

activating the receiving node by transmitting the first beacon to the receiving node when the data destination is the receiving node;

delivering the data to the receiving node; and deactivating the receiving node by transmitting the second beacon to the receiving node.

* * * * *